US005685184A

United States Patent [19]

Gallagher

[11] Patent Number: 5,685,184

[45] Date of Patent: Nov. 11, 1997

[54] PIN TUMBLER LOCK

[76] Inventor: Francis E. Gallagher, 3800 N. Bradford, LaVerne, Calif. 91750

[21] Appl. No.: 422,603

[22] Filed: Apr. 10, 1995

Related U.S. Application Data

[63] Continuation of Ser. No. 99,523, Jul. 30, 1993, abandoned.

[51] Int. Cl.[6] ..... E05B 27/06

[52] U.S. Cl. ..... 70/358; 70/493; 70/367; 70/379 R

[58] Field of Search ..... 70/358, 367, 379 R, 70/405, 406, 409, 492, 493

[56] References Cited

U.S. PATENT DOCUMENTS

| | | | |
|---|---|---|---|
| 3,303,677 | 2/1967 | Bauer | 70/358 |
| 3,777,520 | 12/1973 | Crepinsek | 70/358 |
| 4,122,694 | 10/1978 | Gretler | 70/406 |
| 4,137,739 | 2/1979 | Keller | 70/358 |
| 4,404,824 | 9/1983 | Hennessy | 70/358 X |
| 4,516,416 | 5/1985 | Prunbauer et al. | 70/358 X |
| 4,761,977 | 8/1988 | Weatherby | 70/493 |
| 4,771,620 | 9/1988 | Kleinhany | 70/358 X |
| 4,823,575 | 4/1989 | Florian | 70/493 X |
| 5,148,690 | 9/1992 | Wang | 70/358 X |
| 5,265,453 | 11/1993 | Konii et al. | 70/379 R |

FOREIGN PATENT DOCUMENTS

| | | | |
|---|---|---|---|
| 213069 | 3/1987 | European Pat. Off. | 70/358 |
| 305336 | 3/1989 | European Pat. Off. | 70/358 |
| 2396144 | 3/1979 | France | 70/358 |
| 340152 | 9/1959 | Switzerland | 70/358 |
| 9110795 | 7/1991 | WIPO | 70/358 |

*Primary Examiner*—Suzanne Dino
*Attorney, Agent, or Firm*—Boniard I. Brown

[57] ABSTRACT

A pin tumbler lock has a rotary plug with three rows of tumbler pin mounting holes to accommodate a large number of tumblers. Rotational control of the plug is by means of a stop plate carried on a stem which is an integral extension of the plug. The lock cylinder has a rearwardly extending tab having its opposite side edges in registration with stop surfaces on the stop plate to limit the plug motion in two directions. The lock may be shortened by such provision of exterior rotational control to provide a shortened locking dimension and/or to accommodate a substantial number of pins and tumblers.

32 Claims, 3 Drawing Sheets

PIN TUMBLER LOCK

This is a continuation of application Ser. No. 08/099,523 filed on Jul. 30, 1993 and now abandoned.

BACKGROUND AND SUMMARY OF THE INVENTION

The present invention relates to pin tumbler cam locks, and more particularly to a pin tumbler cam lock of relatively small outer dimensions and short length, which can contain a relatively large number of tumbler pins. In one embodiment of the invention, the cam lock comprises an outer housing shell of about 1" in length, and a locking length of about ¾", and contains seventeen tumbler pins.

Conventional pin tumbler cam locks usually comprise an annular cylinder within a lock housing, and a rotary plug within the cylinder. Such a plug has a row of individual tumbler pins slidable toward or away from the plug rotational axis. The annular cylinder has a corresponding row of spring-biased drive pins in registration with the tumbler pins. The drive pins are normally urged partway into the mounting holes for the tumbler pins so that the plug cannot rotate.

In the locked position, a key may be inserted into a key slot in the plug to push the tumbler pins outwardly, thereby moving the drive pins out of the tumbler pin mounting holes. These tumbler pin movements are such that the outer ends of the tumbler pins will be coincident with the plug outer surface, whereby the plug can be rotated to the open position by turning the key. The plug carries a lock plate that swings behind a keeper to lock a door upon which the lock is mounted, or unlock a lock in accordance with the direction of rotation of the plug. The key cannot be withdrawn in the unlocked position. U.S. Pat. No. 5,038,589 to Martin shows a representative pin tumbler lock construction of the described type.

The present invention is concerned with a pin tumbler cam lock having a multiplicity of rows of pin tumblers, whereby a relatively large number of tumbler pins can be accommodated in a relatively small size lock housing. In one embodiment of the invention, the rotary plug has a key slot of narrow rectangular cross-section. The mating key has two parallel flat side surfaces and two connecting edge surfaces. Rows of conical depressions are defined in the flat side surfaces and the edge surfaces of the key. The plug has three rows of tumbler pins so located that the inner ends of the pins register with the conical depressions in the key. The pin inner ends are preferably conically shaped to mate with the conical depressions.

When the key is inserted into the key slot the depression surfaces act as cams to locate the tumbler pins at the correct height in their mounting holes. Spring-biased drive pins are mounted in a stationary cylinder surrounding the rotary plug to normally extend partway into the mounting holes for the tumbler pins. The key moves the tumbler pins outwardly to drive the drive pins out of the plug, thereby freeing the plug for rotational motion. A distinguishing feature of the lock is that three rows of tumbler pins extend radially from the pin rotational axis. One side row contains five sets of drive pins, tumbler pins and springs (FIG. 5) and the remaining side and edge rows contain six sets of drive pins, tumbler pins, and spring (FIG. 5) or a total of seventeen sets; for securing the lock in its locked position, whereby the lock is resistant to being picked by a would-be thief.

Because the lock contains a relatively large number of tumbler pins, the rotary plug is precisely controlled with respect to the plug rotational position when the plug is in its key-insertion position. If the plug is in an incorrect position the tumbler pins will not precisely register with the drive pins or the depressions in the key, thereby preventing the lock from being unlocked or locked. Preferably, the plug motion is controlled or limited so that the plug is within one rotational degree of its designated key-insertion position. With such accuracy, the tumbler pins are correctly aligned with the drive pins and the depressions in the key surfaces.

Control of plug motion is provided by an important feature of the invention, a stop arm or tab extending from the rear of the stationary cylinder through an aperture in the rear of the lock housing shell and cooperating with a stop plate carried on the rotary plug and in registration with the stop arm. The stop arm is designed to limit rotation of the stop plate in two directions—i.e., to determine the plug position in the locked condition of the lock, and the plug position in the unlocked condition of the lock. By using the single stop arm to determine both end positions of the rotary plug, it is possible to more accurately control plug motion. Manufacturing tolerances and tolerance build-ups become less of an adverse factor.

The invention thus provides means for control of plug rotational motion, on the exterior of the lock structure, and eliminates conventional means within the lock structure for accurately controlling such rotation, such as the well-known plug pin extending through a slot and engaging an end of the slot. The space or length required for the conventional arrangement is not needed. Shorter lock length and shorter locking dimension are therefore provided, the latter being the distance between the back of the housing head and the front surface of a lock plate. In one embodiment, a locking dimension of ¾" is provided. Devices according to the invention can therefore meet requirements for locks with short locking dimensions to fit within required spaces, as in casino gaming machines at casinos.

The elimination of rotational control means within the lock structure and independent of the lock housing not only enables a shorter lock, but can do so without decrease in the number of pins or tumblers, while maintaining precise rotational control. This makes possible a larger range of keying of the smaller version to larger locks conventionally utilized. The unique rotation control arrangement of the invention also enables the addition of an additional pin, such as a sixth pin, so that a substantial number of key codes may be utilized. An added first pin may serve to restrict keys which are conventionally available from operating the lock.

The lock is designed to provide smooth key action and a full locking action of all of the drive pins in the various holes in the rotary plug. The smooth key action is achieved by the stop arm being an integral part of the stationary cylinder. Another factor is that the stop plate is carried on a stem that is an integral part of the rotary plug. Manufacturing tolerance variations thus have a reduced negative effect on the lock action. Manufacturing costs are substantially reduced.

The stop plate is removably attached to the plug so that the plate may be removed and replaced with a differently configured stop plate. This feature enables a user to select different plug rotations when going from the locked to the unlocked condition. For example, with one stop plate configuration a plug rotation of ninety degrees can be used to go from the locked condition to the unlocked condition, whereas with a different stop plate configuration a plug rotation of one hundred eighty degrees will be employed for movement of the plug from the locked to the unlocked condition. Different stop plate configurations may be utilized to provide a range of plug rotations up to about three hundred sixty degrees. The labor costs for changing amounts of plug rotation are thus greatly reduced.

Each stop plate is reversible to provide a choice of direction when going from the locked to the unlocked condition. For example, with the stop plate facing in one direction the plug is turnable clockwise to unlock the lock and with the same stop plate reversed to face in the opposite direction, the plug is turnable counterclockwise to move the plug to the unlocked condition.

DESCRIPTION OF A PREFERRED EMBODIMENT OF THE INVENTION

Figure 1:
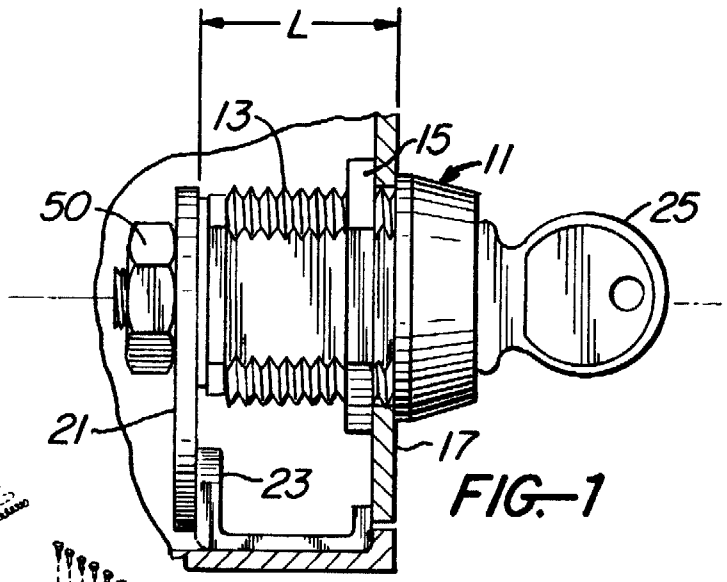
FIG. 1 is a side elevational view of a pin tumbler lock according to the present invention.
Figure 2:
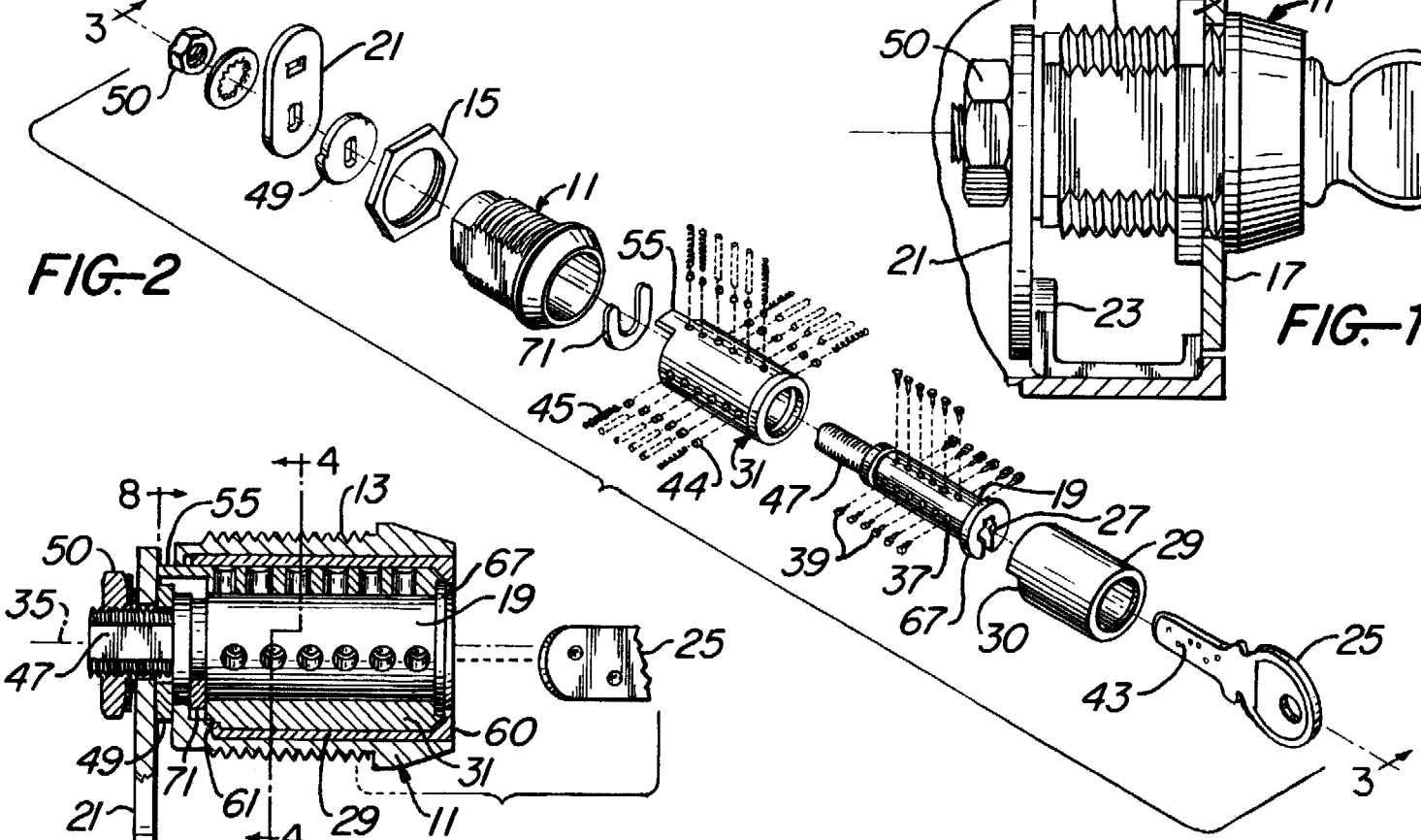
FIG. 2 is an exploded perspective view of the lock of FIG. 1.
Figure 3:
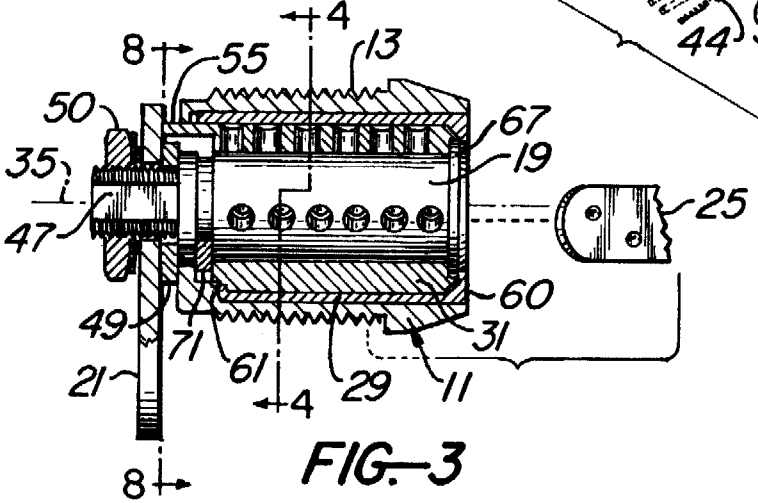
FIG. 3 is an elevational sectional view of the lock of FIG. 1.

Referring to FIGS. 1 through 3 of the drawings, there is shown a key-operated lock comprising a housing shell 11 having a threaded side surface 13 adapted to receive a nut 15, whereby the housing shell can be mounted on a wall 17, which might, for example, be the outer door of a vending or gaming machine. The dimension indicated at L is known in the art as a locking dimension which, as discussed herein, may be substantially shortened in accordance with the invention. The lock includes a rotary plug 19 that carries a lock plate 21.

As shown in FIG. 1, the lock plate extends downwardly to engage a fixed keeper 23, whereby the lock is in its locked condition to prevent rightward motion of wall (door) 17. A key 25 is insertable into a key slot 27 in the plug to rotate the plug to lock or unlock the lock. The key is withdrawable from the key slot 27 only when the lock is in its locked condition.

Figure 11:
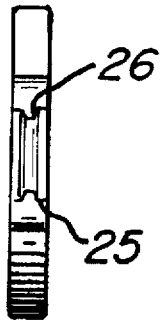
FIG. 11 is an end view of the key of FIG. 10.
Figure 10:
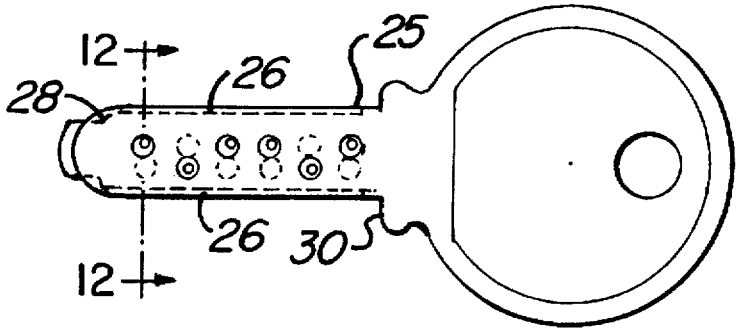
FIG. 10 is a side elevational view of a key which may be utilized with the lock of FIGS. 1 through 9.
Figure 12:
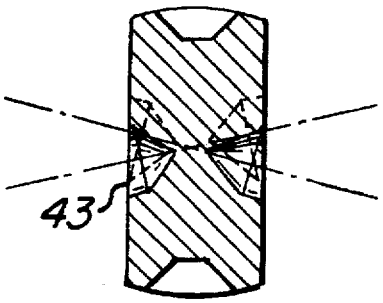
FIG. 12 is an enlarged sectional view taken on line 12—12 in FIG. 10.

FIGS. 10 through 12 illustrate a preferred key construction, wherein the key has two flat side faces, an upper edge, and a lower edge. Grooves 26 are defined in the upper and lower edges of the key. In the illustrated device, only the groove in the key upper edge has a function, being designed to interact with a row of vertically oriented tumbler pins 39 within plug 19.

The tip of key 25 defines a deeper groove portion 28 (FIG. 10) adapted to interact with the endmost vertical tumbler pin 39 (FIG. 2) in the upper edge row of pins. Insertional motion of the key may be limited in various ways. For example, shoulder surfaces 30 (FIG. 10) may serve as stop surfaces accurately to limit the insertional motion of the key so that conical depressions 43 in the edge and side faces of the key align with tumbler pins in the row of pins 39. When the key is fully inserted into the lock, grooves 26, 28 and the various depressions 43 will be in simultaneous registry with the various tumbler pins 39, whereby the key can be turned to unlock the lock.

The depressions 43 in the key side faces are asymmetrical relative to the longitudinal axis of the key. Therefore, the key must be inserted with one particular edge uppermost to be effective. However, with a key design having two symmetrical rows of depressions, the key can be inserted with either edge uppermost.

Within the scope of the invention, it is contemplated that groove 26 may be replaced by a row of conical depressions spaced apart according to the spacing of the associated tumbler pins 39. The deepened groove 28 interacts with an elongated tumbler pin to allow increased depth of penetration of the key required to activate the tumblers. The key design of FIG. 10 cannot be duplicated by conventional key-cutting machines. Therefore, the illustrated key provides assurance against unauthorized opening of the lock.

As shown in FIGS. 2 & 3, the lock comprises a steel housing sleeve 29 telescoped into housing shell 11. The purpose of the steel sleeve is to provide a sleeve inner surface which is precisely centered relative to the lock rotational axis, whereby the positions of the drive pins and tumbler pins are precisely controlled in relation to the rotational axis. Housing shell 11 is ordinarily a zinc die casting without precision surfaces.

Mounted within sleeve 29 is an annular cylinder 31, preferably formed of brass and having an inner cylindrical surface that acts as a bearing for the rotary plug 19. Plug 19 may also be formed of brass. The plug is adapted to rotate about a central axis 35. The key slot 27 extends longitudinally within plug 19 in generally parallel relation to the plug rotational axis, whereby when key 25 is inserted into the slot the key is turnable to rotate the plug about its central axis.

Plug 19 has three rows of holes extending from its outer surface to the key slot 27. FIG. 2 shows two rows of holes 37 in the plug surface, the third row of holes extending from the non-visible surface of the plug. As shown in FIG. 2, each row contains five or six holes 37 for a total of seventeen holes in the plug. Each hole is designed to slidably receive a tumbler pin 39.

Figure 4:
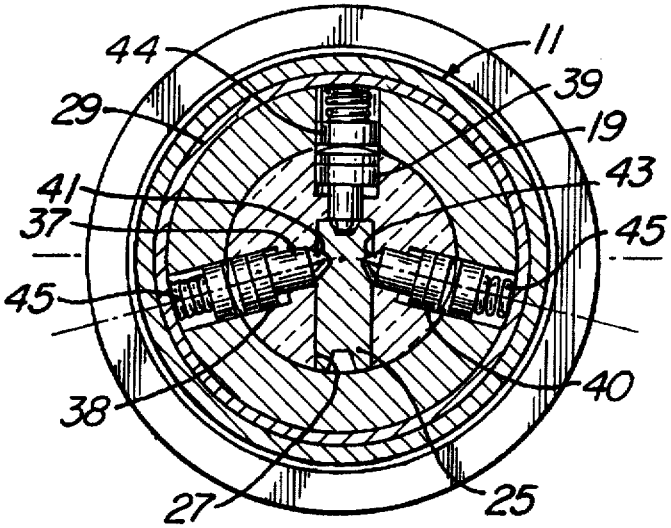
FIG. 4 is an enlarged sectional view taken essentially on line 4—4 in FIG. 3.

As best shown in FIG. 4, a representative hole 37 has a counterbore 38 designed to accommodate the enlarged head 40 of the associated tumbler pin 39. The shank portion of each tumbler pin has a conical inner end 41. When the key 25 is inserted into the key slot 27, conical depressions 43 in the key surfaces mate with the conical ends 41 of tumbler pins 39 to move the pins outwardly in their mounting holes 37. When the key is withdrawn from slot 27 (FIG. 9), the tumbler pins 39 are driven toward the plug central axis to further penetrate the slot 27 space. Spring-biased drive pins 44 are slidably mounted in socket holes in cylinder 31 (FIG. 3) to provide the necessary forces to move the tumbler pins 39 toward the plug central axis. The shoulder surfaces of counterbores 38 limit movements of pins 39 toward the plug central axis.

Each drive pin 44 has an associated coil spring 45, whereby when key 25 is removed from slot 27 each drive pin extends part way into the associated counterbore 38 in plug 19 (FIG. 9), thus to prevent the plug from rotating.

Figure 5:
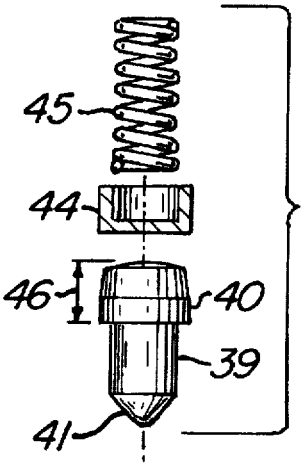
FIG. 5 is an enlarged exploded view of a representative drive pin and tumbler pin arrangement utilized in the lock of FIGS. 1 through 4.
Figure 6:
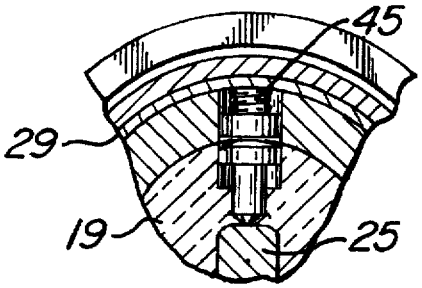
FIG. 6 is a fragmentary sectional view taken in the direction of FIG. 4, showing the lock during insertion of a key into the key slot.

The shank portions of the tumbler pins 39 have the same length. However, the head portions 40 of the tumblers may have varying lengths, for example length dimension 46 of head 40 in FIG. 5. In a representative structure four different head 40 lengths are used—i.e., 1.79 mm., 1.44 mm., 1.09 mm., and 1.34 mm. Each pin 39 has one of such head dimension 46. The conical depressions in the key surfaces vary in depth, whereby when key 25 is inserted into the key slot all of the tumbler pins are forced outwardly in their respective mounting holes to positions wherein all of the drive pins are out of counterbores 38 (FIG. 4). The key then can be turned to rotate the plug to the unlocked condition or back to the locked condition.

Plug 19 has an integral stem 47 that extends rearwardly beyond the rear end of housing shell 11 (FIGS. 3 and 7) and has parallel flat side faces to serve as mounting surfaces for a stop plate 49 and the lock plate 21. The two plates are retained on stem 47 by a nut 50, which, as shown in FIG. 7, can be tightened to force plate 49 against a shoulder 51 defined at the forward end of stem 47.

Figure 7:
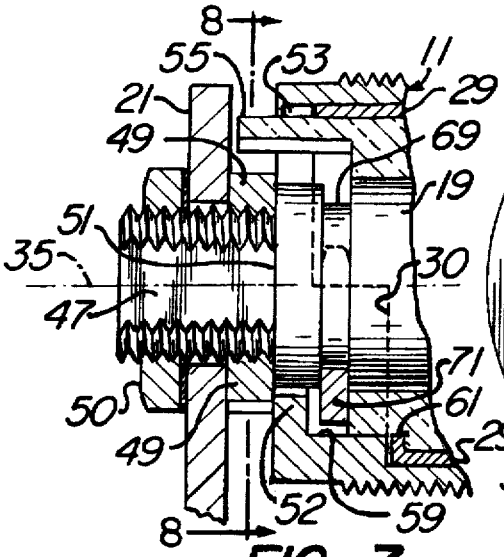
FIG. 7 is an enlarged fragmentary sectional view taken in the direction of FIG. 3, showing structural details.
Figure 8:
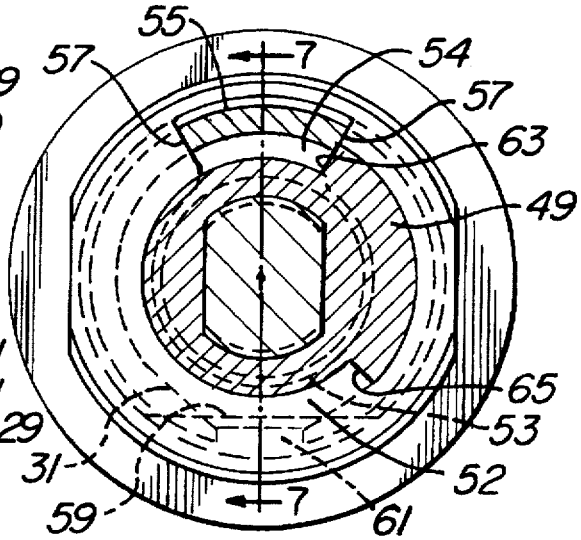
FIG. 8 is a sectional view taken on line 8—8 in FIG. 7.

Housing shell 11 has a thickened rear wall 52 FIG. 7 with an opening and an adjoining outer arcuate aperture 54 extending therethrough (FIG. 8). Cylindrical plug 19 extends through the circular portion of this aperture. An arm or tab 55 extends rearwardly from the rear end of cylinder 31 through the outer portion 54 of the aperture. Edge surfaces 57 of arm 55 have the same spacing as the spacing across the outer arcuate portion 34 of aperture 53 in the housing shell rear wall 52. Therefore tab 55 serves to lock cylinder 31 against rotation relative to the housing shell 11. The housing shell has an internal flat surface 59 (FIGS. 7 and 8) to mate with a flat external surface on cylinder 31, thus to additionally lock the housing shell to the cylinder. To accommodate the mating flat surfaces, sleeve 29 is cut away at its rear end, as shown in FIG. 2 and in dotted line 30 in FIG. 7, and in FIG. 2 with respect to surface 30.

Sleeve 29 has an inwardly extending annular flange 60 at its front end which overlies the front end of cylinder 31 (FIG. 3). At its rear end, the sleeve has a portion 61 (FIG. 7) which is crimped or bent into a recess or notch in the undersurface of cylinder 31, whereby sleeve 29 is secured to the cylinder to prevent relative rotation, and to restrict attack on the lock by extraction of the sleeve. The cylinder 31, plug 19 and sleeve 29 are removable as a unit through the front opening in housing shell 11 after nut 50 and plates 21, 49 have been removed from stem 47.

The front face of stop plate 49 abuts the surface of housing shell rear wall 52 so that when plug 19 is rotating, the plate 49 acts as a thrust bearing to prevent axial play of the plug in housing shell 11. Plate 49 also serves to limit rotary motion of the plug. As seen in FIG. 8, plate 49 has edge surfaces defining shoulders 63, 65. Shoulder 63 is shown engaged with the right edge of tab 55 so that plug 19 cannot move counterclockwise. The plug can rotate clockwise until projection 65 on the stop plate abuts the other (left as viewed) edge 57 of arm 55.

Figure 9:
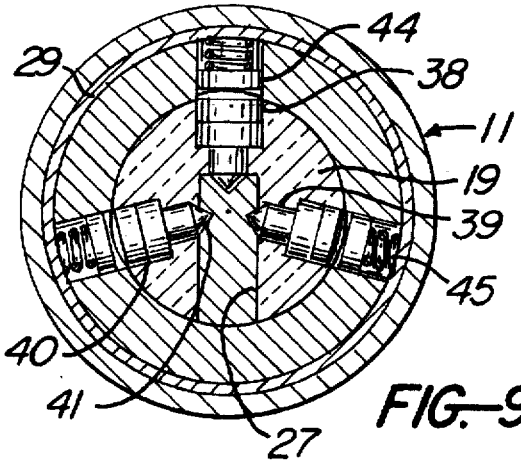
FIG. 9 is a view in the direction of FIG. 4, showing the lock with the key removed.

Tab or arm 55 serves as a stop to limit plug rotation in both directions. The arm being an integral extension of cylinder 31, it has a precise relation to the socket holes in the cylinder, and thus forms a precision stop for accurately locating plug 19 so that all of the tumbler pins 39 are in registration with the associated drive pins 44. FIGS. 8 and 9 show the single plug position wherein key 25 can be inserted into slot 27—i.e., the plug position wherein the tumbler pins 39 may be driven outwardly by key 25 to move drive pins 44 out of counterbores 38. FIG. 9 shows plug 19 in a position sometimes referred to herein as the key-acceptance position.

A feature of the invention is the engagement of the projection or tab 55 with shoulder 63 of stop plate 49 to define the key-acceptance position of the plug. Shoulder 65 engages the left edge of tab 55 when the plug reaches the unlocked position of the lock. The key cannot be withdrawn from the key slot when plug 19 is in the unlocked position.

Stop plate 49 can be reversed so that the front face becomes the rear face, and the rear face becomes the front face. With such a mirror image reversal of the stop plate, shoulder 63 abuts the left edge of tab 55, and shoulder 65 of plate 49 abuts the right edge of arm 55 (as viewed in FIG. 8). Reversal of stop plate 49 serves to change the rotational direction of the key required to operate the lock for locking or unlocking.

Figure 13:
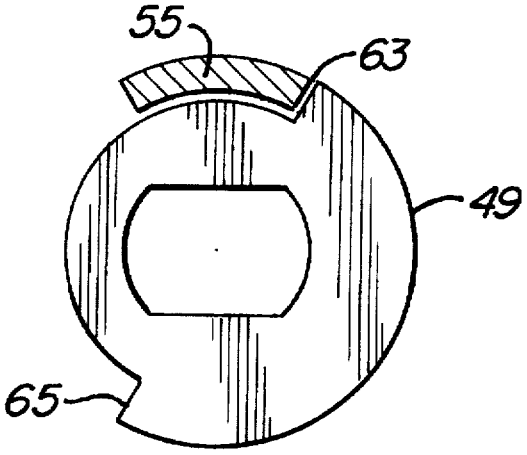
FIG. 13 is an elevational view of a stop plate that may be used in the lock of FIGS. 1 through 9.

FIG. 13 illustrates an alternate stop plate structure wherein the shoulder 65 is spaced a further circumferential distance away from shoulder 63, in comparison to the FIG. 8 arrangement. The FIG. 13 stop plate provides for less rotational motion of plug 19 between its limiting positions.

Different stop plate configurations may be utilized—i.e., stop plates having different circumferential spacings of shoulder 63 and projection 65. The choice of stop plate is dictated by the key rotational motion desired in going from the unlocked to the locked condition. Any given stop plate configuration can be reversed on stem 47 to change the lock rotational direction for a given lock action.

FIG. 12 shows alternate angulations of the conical depressions in the side faces of key 25. The axis of a given conical depression may incline upwardly or downwardly, as shown in FIG. 12. The tumbler pins 39 are similarly inclined to mate the conical ends of the pins with the conical depressions.

Referring to FIG. 3, plug 19 has an annular radial flange 67 at its front end mated to an annular recess in the cylinder 31 front end. The front faces of the plug and sleeve 29 are coplanar with the front face of housing shell 11, whereby the lock presents a single flat visible front face.

It is desirable to minimize any possibility of end play between plug 19 and cylinder 31. Therefore, as shown in FIG. 7, the plug has an annular groove 69 in the plane of the cylinder rear end surface. A semi-circular retainer 71 is disposed in said groove to prevent forward motion of the plug relative to the cylinder. Retainer 71 augments the end play preventive function of plate 49.

A principal feature of the invention comprises the three rows of tumbler pins and drive pins extending radially from the plug central axis. As shown in FIGS. 4 and 9, one row of pins penetrates the edge of the rectangular key slot 27 to enter depressions 43 in the upper edge of key 25, whereas the other two rows of pins penetrate the flat side faces of the slot to enter into depressions 43 in the key side faces. The mounting holes for the pins in adjacent rows are staggered (FIG. 3), thus not to unduly weaken the bridges defined between the holes. The pin arrangement enables the lock to accommodate a large number of tumbler pins.

Referring to FIG. 10, the groove 28 is deeper than the associated groove 26. The tumbler pin associated with groove 28 has a somewhat longer shank than the other tumbler pins, so that the key must have the deepened groove 28 in order to fully penetrate the key slot. Groove 28 is an anti-theft feature, because conventional key machines are not capable or adapted to define the deepened groove 28. Groove 28 and the associated tumbler pin 39 may have varying dimensions to increase the number of lock combinations. Within the broader aspects of the invention, the depth dimensions of depressions 43 may also be varied to provide added combinations.

Thus there has been shown and described a novel pin tumbler cam lock which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A key-operated lock having a forward end and a rearward end, comprising:

a housing having a forward opening, a cylinder member disposed in said housing and defining at least one row of socket holes, said cylinder member having a rearwardly extending tab, drive pins disposed in said socket holes, a plug rotatable in said cylinder and defining a key slot, said plug having a rearwardly extending stem, said plug having at least one row of pin holes extending radially from the key slot through the plug, said pin holes being registrable with said socket holes, said housing having a rearward opening and an aperture extending radially from said opening for extension therethrough of said cylinder tab, and a stop plate rotatable with said plug stem, said stop plate being adjacent to the housing and defining a shoulder for engagement with said cylinder tab, said stop plate shoulder and said cylinder tab being accurately sized and positioned to accurately rotationally position the plug in a key-acceptance position, whereby the lock is shortened and provides additional pins and holes for increased possible lock combinations.

2. A lock according to claim 1, wherein:

said housing provides an annular seating surface for said cylinder, said housing having a rear wall with an opening therethrough, said plug has a stem portion extending rearwardly through said opening, and said stop plate is mounted on said stem portion with a front face thereof seating against the rear wall of said housing to prevent removal of the plug.

3. A lock according to claim 2, wherein:

said stop plate has an edge surface disposed in a radial plane extending through said tab, and the edge surface of said plate defines a shoulder adapted to abut said tab to locate the plug in its key-acceptance position.

4. A lock according to claim 3, wherein:

said stop plate is reversible on the stem portion of the plug to provide a mirror image adjustment of the shoulder about a mid-plane of said tab, whereby the plug is rotatable clockwise or counterclockwise in response to turning motion of the key in the key slot.

5. A lock according to claim 1, wherein:

said housing comprises a shell and a sleeve telescoped thereinto, and said shell is die cast and has an inner cylindrical surface concentric with the plug.

6. A lock according to claim 5, wherein:

said housing sleeve has a front end and a rear end, said sleeve has an inwardly extending annular flange overlying a cylinder end, and said sleeve has its rear end portion crimped or turned into a notch in the cylinder to prevent relative rotation and to resist attack on the lock by extraction of the sleeve.

7. A lock according to claim 6, wherein:

said cylinder has a front end portion and an annular recess in the cylinder front end portion, and said plug has a front end and a radial flange extending into said annular recess, said plug and sleeve and housing shell having front faces disposed in a common plane normal to the plug rotational axis.

8. A lock according to claim 1, and further comprising:

an annular groove defined in said plug in the plane of the cylinder rear end, and a semi-circular retainer in said groove to prevent forward motion of the plug through the cylinder.

9. A lock according to claim 1, wherein each row of holes has at least five holes.

10. A lock according to claim 1, wherein:

said key slot extends into said plug stem for a substantial portion of the length of the stem.

11. A lock according to claim 1, wherein:

there are three rows of holes, and at least five holes are defined in each of said rows, and a total of at least seventeen holes is provided.

12. A lock according to claim 11, wherein:

said key slot is of rectangular cross-section with two flat parallel side surfaces and an edge surface connecting said side surfaces, one row of holes communicating with one of the edge surfaces of the key slot, the other two rows of holes communicating with the parallel side surfaces of the key slot, and the holes of each row being staggered relative to the holes in the other adjacent rows.

13. A lock according to claim 1, wherein:

said housing comprises a sleeve telescopically received in the housing, and said housing sleeve is formed of wear-resistant material and has an inner cylindrical surface concentric with said cylinder.

14. A key-operated lock having forward and rearward ends, comprising:

a housing having a forward opening and a rearward opening, a cylinder member disposed within said housing means and defining at least one row of socket holes, said cylinder member having a rearwardly extending tab, drive pins disposed in said socket holes, a generally cylindrical plug rotatable in the cylinder member, said cylinder plug defining a longitudinal key slot and having a rearwardly extending threaded stem to receive a threaded fastener to secure components together, said plug having at least one row of pin holes extending radially from the key slot through the plug, said pin holes being registrable with said socket holes, said housing means having an aperture extending radially from said rearward opening for extension therethrough of said cylinder tab, respective tumbler pins disposed in respective ones of said pin holes, a stop plate rotatable with said plug and abutting the housing to retain the plug, said plug having at least one shoulder to engage said cylinder tab, said plug being rotatable to a key-acceptance position wherein said drive pins are in registration with said tumbler pins, said key-acceptance position being determined by engagement of said cylinder member tab with said stop plate shoulder, said stop plate shoulder and said cylinder tab being accurately sized and positioned for accurate engagement and accurate rotational positioning of the plug in its said key-acceptance position, and a key having at least one row of depressions registrable with said at least one row of plug pin holes with the key inserted in said key slot, whereby the tumbler pins urge the drive pins to enable key rotation for unlocking.

15. A lock according to claim 14, and further comprising:

a key insertable into said key slot, said key having at least one row of conical depressions registrable with the holes in the plug upon insertion of the key into the key slot, whereby key rotation moves the tumbler pins to move the drive pins out of the socket holes.

16. A lock according to claim 15, wherein there are at least two rows of holes in said plug.

17. A lock according to claim 16, wherein:

said key slot is rectangular in cross-section, and has two parallel side surfaces and two edge surfaces connecting said side surfaces, and said key has two rows of dissimilar conical depressions in one of said side surfaces, two rows of dissimilar conical depressions in the other side surface, and a row of conical depressions in each of said edge surfaces.

18. A lock according to claim 15, wherein:

said key has a groove defined in an edge thereof and having a deepened section at a key leading end, and one of the tumbler pins is elongated to engage said deepened section of the key groove when the key is fully inserted into the key slot.

19. A lock according to claim 15, wherein:

the tumbler pins have head portions of varying axial dimensions, whereby different ones of the tumbler pins are required to move different distances to move associated drive pins out of the plug pin holes.

20. A lock according to claim 15, wherein said tumbler pins have conical inner end portions, and said key has conical depressions adapted to mate with the tumbler pins end portions.

21. A lock according to claim 20, wherein there are at least two rows of holes in said plug.

22. A lock according to claim 21, wherein:

said key slot is rectangular in cross-section, and has two parallel side surfaces and two edge surfaces connecting said side surfaces, and said key has two rows of dissimilar conical depressions in one of said side surfaces, two rows of dissimilar conical depressions in the other side surface, and a groove in each of said edge surfaces.

23. A lock according to claim 20, wherein:

said key has a groove defined in an edge thereof and having a deepened section at a key leading end, and one of the tumbler pins is elongated to engage said deepened section of the key groove when the key is fully inserted into the key slot.

24. A lock according to claim 14, wherein:

said housing provides an annular seating surface for said cylinder, said housing having a rear wall with an opening therethrough, said plug has a stem portion extending rearwardly through said opening, and said stop plate is mounted on said stem portion with a front face thereof seating against the rear wall of said housing to prevent removal of the plug.

25. A lock according to claim 24, wherein:

said stop plate has an edge surface disposed in a radial plane extending through said tab, and the edge surface of said plate defines a shoulder adapted to abut said tab to locate the plug in its key-acceptance position.

26. A lock according to claim 25, wherein:

said stop plate is reversible on the stem portion of the plug to provide a mirror image adjustment of the shoulder about a mid-plane of said tab, whereby the plug is rotatable clockwise or counterclockwise in response to turning motion of the key in the key slot.

27. A lock according to claim 14, wherein:

said housing comprises a shell and a sleeve telescoped thereinto, and said shell is die cast and has an inner cylindrical surface concentric with the plug.

28. A lock according to claim 14, and further comprising:

an annular groove defined in said plug in the plane of the cylinder rear end, and a semi-circular retainer in said groove to prevent forward motion of the plug through the cylinder.

29. A lock according to claim 14, wherein:

said key slot extends into said plug stem for a substantial portion of the length of the stem.

30. A lock according to claim 29, wherein:

said key slot is of rectangular cross-section with two flat parallel side surfaces and an edge surface connecting said side surfaces, one row of holes communicating with one of the edge surfaces of the key slot, the other two rows of holes communicating with the parallel side surfaces of the key slot, and the holes of each row being staggered relative to the holes in the other adjacent rows.

31. A lock according to claim 14, wherein said depressions are conically shaped, and said tumbler pins have conical inner end portions adapted to mate with the conical depressions.

32. A lock according to claim 14, wherein:

the tumbler pins have head portions of varying axial dimensions, whereby different ones of the tumbler pins are required to move different distances to move associated drive pins out of the plug pin holes.

* * * * *